US009484646B2

(12) United States Patent
Thomas

(10) Patent No.: US 9,484,646 B2
(45) Date of Patent: Nov. 1, 2016

(54) CABLE CONNECTOR STRUCTURED FOR REASSEMBLY AND METHOD THEREOF

(71) Applicant: PPC Broadband, Inc., East Syracuse, NY (US)

(72) Inventor: Charles E. Thomas, Athens, PA (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 14/600,706

(22) Filed: Jan. 20, 2015

(65) Prior Publication Data

US 2015/0207243 A1 Jul. 23, 2015

Related U.S. Application Data

(60) Provisional application No. 61/929,841, filed on Jan. 21, 2014.

(51) Int. Cl.
*H01R 9/05* (2006.01)
*H01R 43/00* (2006.01)

(52) U.S. Cl.
CPC ..... *H01R 9/0521* (2013.01); *H01R 43/002* (2013.01); *Y10T 29/49174* (2015.01)

(58) Field of Classification Search
CPC . H01R 9/0521; H01R 9/0503; H01R 9/0524
See application file for complete search history.

(56) References Cited

U.S. PATENT DOCUMENTS 4,277,873 A 7/1981 Smith
4,346,958 A * 8/1982 Blanchard ..... H01R 24/40 439/584
5,586,910 A 12/1996 Del Negro et al.
6,102,738 A * 8/2000 Macek ..... H01R 4/5075 439/584
6,331,123 B1 * 12/2001 Rodrigues ..... H01R 9/0524 439/584
6,802,739 B2 * 10/2004 Henningsen ..... H01R 9/0521 439/584
6,884,115 B2 * 4/2005 Malloy ..... H01R 9/0521 439/584
6,955,562 B1 10/2005 Henningsen
7,005,963 B1 2/2006 Scalisi et al.
7,029,304 B2 4/2006 Montena
7,077,700 B2 * 7/2006 Henningsen ..... H01R 9/0521 439/583
7,104,839 B2 9/2006 Henningsen
7,163,420 B2 1/2007 Montena
7,329,149 B2 * 2/2008 Montena ..... H01R 9/0518 439/578
7,465,190 B2 12/2008 Henningsen
7,500,873 B1 3/2009 Hart
7,621,778 B1 * 11/2009 Paynter ..... H01R 9/0521 439/584
7,934,954 B1 * 5/2011 Chawgo ..... H01R 9/0524 439/578

(Continued)

FOREIGN PATENT DOCUMENTS

EP 1763909 B1 1/2015
WO 0193561 A2 12/2001

(Continued)

OTHER PUBLICATIONS

US/RO, International Search Report and Written Opinion from PCT/US2015/012195 as completed May 8, 2015 (total 19 pages.).

*Primary Examiner* — Ross Gushi
(74) *Attorney, Agent, or Firm* — Barclay Damon, LLP

(57) ABSTRACT

A connector includes, in one embodiment, a body assembly configured to be secured to a prepared end of a coaxial cable. The connector has a coupler assembly connected to the body assembly for connecting the body assembly to an interface port. The connector also has a flexible interlock to facilitate repeated assembly and disassembly of the connector.

44 Claims, 14 Drawing Sheets

(56) References Cited

U.S. PATENT DOCUMENTS 7,950,961 B2 * 5/2011 Chabalowski ..... H01R 9/0521 439/578
7,972,176 B2 * 7/2011 Burris ..... H01R 9/0521 439/584
7,993,159 B2 * 8/2011 Chawgo ..... H01R 9/0524 439/584
8,007,314 B2 * 8/2011 Chawgo ..... H01R 9/0524 439/548
8,038,472 B2 * 10/2011 Montena ..... H01R 9/0524 439/578
8,123,557 B2 * 2/2012 Montena ..... H01R 9/0527 439/584
8,177,583 B2 * 5/2012 Chawgo ..... H01R 9/0524 439/584
8,287,309 B1 * 10/2012 Thomas ..... H01R 9/0524 439/578
8,366,482 B2 * 2/2013 Burris ..... H01R 9/0521 439/584
8,388,375 B2 * 3/2013 Chawgo ..... H01R 9/0524 439/578
8,430,688 B2 * 4/2013 Montena ..... H01R 24/564 439/578
8,435,073 B2 * 5/2013 Wild ..... H01R 24/564 439/578
8,439,703 B2 * 5/2013 Natoli ..... H01R 24/564 439/578
8,444,445 B2 5/2013 Amidon et al.
8,449,325 B2 * 5/2013 Wild ..... H01R 24/564 439/578
8,591,254 B1 * 11/2013 Chawgo ..... H01R 9/0524 439/578
8,602,818 B1 * 12/2013 Chawgo ..... H01R 9/0524 439/578
8,628,352 B2 * 1/2014 Nugent ..... H01R 9/05 439/578
8,662,455 B2 3/2014 Hernandez et al.
8,708,737 B2 * 4/2014 Chawgo ..... H01R 9/0524 439/578
8,876,553 B2 * 11/2014 Lu ..... H01R 24/38 439/584
9,083,113 B2 * 7/2015 Wild ..... H01R 13/623
9,147,963 B2 * 9/2015 Balcer ..... H01R 9/0524
9,166,306 B2 * 10/2015 Montena ..... H01R 9/0524
9,172,156 B2 * 10/2015 Nugent ..... H01R 9/0518
9,214,771 B2 * 12/2015 Nugent ..... H01R 9/05
9,276,363 B2 * 3/2016 Wild ..... H01R 24/564
2003/0224657 A1 12/2003 Malloy
2004/0142596 A1 * 7/2004 Henningsen ..... H01R 9/0521 439/584
2005/0170692 A1 * 8/2005 Montena ..... H01R 9/0521 439/578
2006/0040552 A1 2/2006 Henningsen
2006/0073726 A1 4/2006 Montena
2006/0194474 A1 * 8/2006 Montena ..... H01R 9/0518 439/578
2008/0003873 A1 1/2008 Henningsen
2008/0207051 A1 * 8/2008 Montena ..... H01R 9/0521 439/578
2008/0274643 A1 * 11/2008 Chawgo ..... H01R 9/0524 439/583
2009/0233482 A1 * 9/2009 Chawgo ..... H01R 9/0524 439/578
2010/0022125 A1 1/2010 Burris et al.
2010/0151728 A1 6/2010 Chabalowski et al.
2010/0273340 A1 * 10/2010 Clausen ..... H01R 24/564 439/277
2011/0230089 A1 9/2011 Amidon et al.
2012/0058673 A1 3/2012 Rodrigues
2012/0088407 A1 * 4/2012 Natoli ..... H01R 24/564 439/585
2012/0171895 A1 7/2012 Burris et al.
2012/0190386 A1 7/2012 Anderson
2012/0214338 A1 * 8/2012 Nugent ..... H01R 4/5066 439/578
2012/0252264 A1 10/2012 Zraik
2013/0012062 A1 1/2013 Nugent
2013/0015288 A1 1/2013 Hernandez et al.
2013/0143439 A1 * 6/2013 Nugent ..... H01R 9/0518 439/585
2013/0244484 A1 * 9/2013 Wild ..... H01R 24/564 439/578
2013/0311372 A1 11/2013 Ramaci
2013/0323968 A1 * 12/2013 Chawgo ..... H01R 9/0524 439/584
2014/0045357 A1 * 2/2014 Nugent ..... H01R 13/5221 439/275
2014/0127941 A1 * 5/2014 Lu ..... H01R 24/38 439/583
2014/0148044 A1 * 5/2014 Balcer ..... H01R 9/0524 439/460
2014/0294052 A1 10/2014 Currivan et al.
2014/0337219 A1 11/2014 Ramaci
2015/0207243 A1 * 7/2015 Thomas ..... H01R 9/0521 439/584

FOREIGN PATENT DOCUMENTS

WO 0193561 A3 12/2001
WO 2005078866 A1 8/2005
WO 2006001999 A1 1/2006
WO 2008005254 A2 1/2008
WO 2008005254 A3 1/2008
WO 2013009368 A1 1/2013
WO 2014145549 A1 9/2014

* cited by examiner

CABLE CONNECTOR STRUCTURED FOR REASSEMBLY AND METHOD THEREOF

CROSS-REFERENCE TO RELATED APPLICATION

This application is a non-provisional of, and claims the benefit and priority of, U.S. Provisional Patent Application No. 61/929,841, filed on Jan. 21, 2014. The entire contents of such application is hereby incorporated by reference.

BACKGROUND

Cable connectors exposed to harsh weather conditions can fuse or lock to the interface ports or "taps" to which they connect. As a consequence, disassembly and reuse such cable connectors can be difficult without destroying or damaging the connector body or its internal components. In addition to the labor costs associated with replacing such connectors, the hardware cost associated therewith can also be significant.

To address these difficulties, some connectors have been designed with internal parts which attempt to facilitate disassembly, such as through the use of spring elements tending to separate the components. Also, certain manufacturing methods attempt to effect ultra-smooth surfaces to reduce friction and improve severability of connector components. Such approaches, however, increase complexity, cost and the need for additional repair/maintenance.

The foregoing background describes some, but not necessarily all, of the problems, disadvantages and challenges related to the reuse of cable connectors.

BRIEF DESCRIPTION OF THE DRAWINGS

Features and advantages of the present disclosure are described in, and will be apparent from, the following Brief Description of the Drawings and Detailed Description.

SUMMARY OF THE INVENTION

A hardline connector is provided including a body assembly configured to secure a prepared end of a coaxial cable and a coupler assembly connected to the body assembly for connecting the body assembly to an interface port. The flexible interlock is configured to apply a first threshold force to separate the coupler and body assemblies by an axial displacement, and a second threshold force, larger than the first threshold force, to disassemble the hardline connector.

A method is also provided to facilitating assembly/disassembly of a hardline connector having a coupler assembly connecting a body assembly to an interface port. The method comprising the steps of: (i) configuring a seizure bushing for axial displacement within a coupler assembly, (ii) connecting the seizure bushing of the coupler assembly to a mandrel support of the body assembly by a flexible interlock disposed between the body and coupler assemblies, and (iii) configuring the flexible interlock such that a first threshold force is required to separate the assemblies by the axial displacement, and a second a second threshold force, larger than the first threshold force, is required to disassemble the hardline connector.

DETAILED DESCRIPTION

Network and Interfaces

Figure 1:
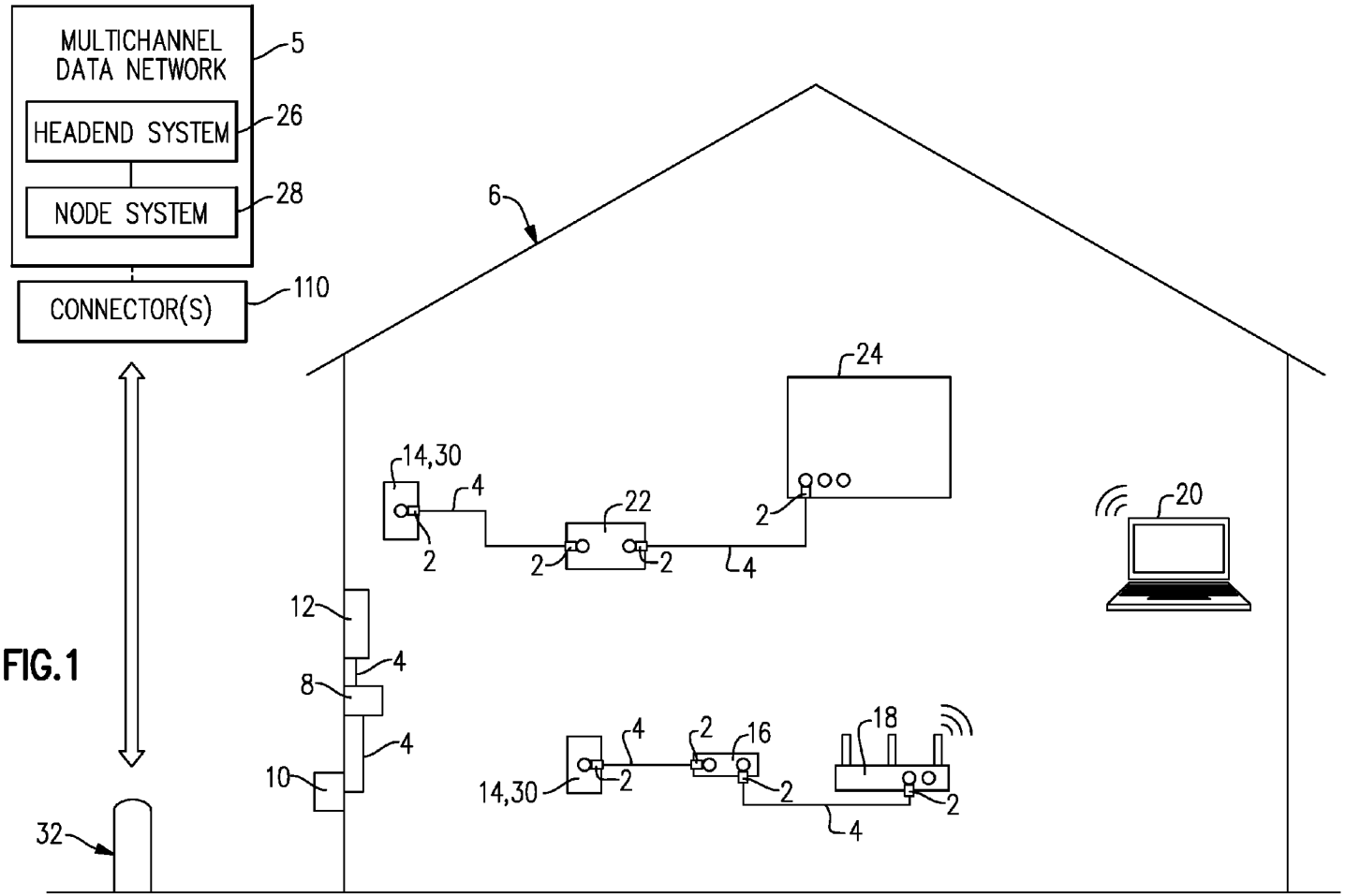
FIG. 1 is a schematic diagram illustrating an environment coupled to a multichannel data network.
Figure 9:
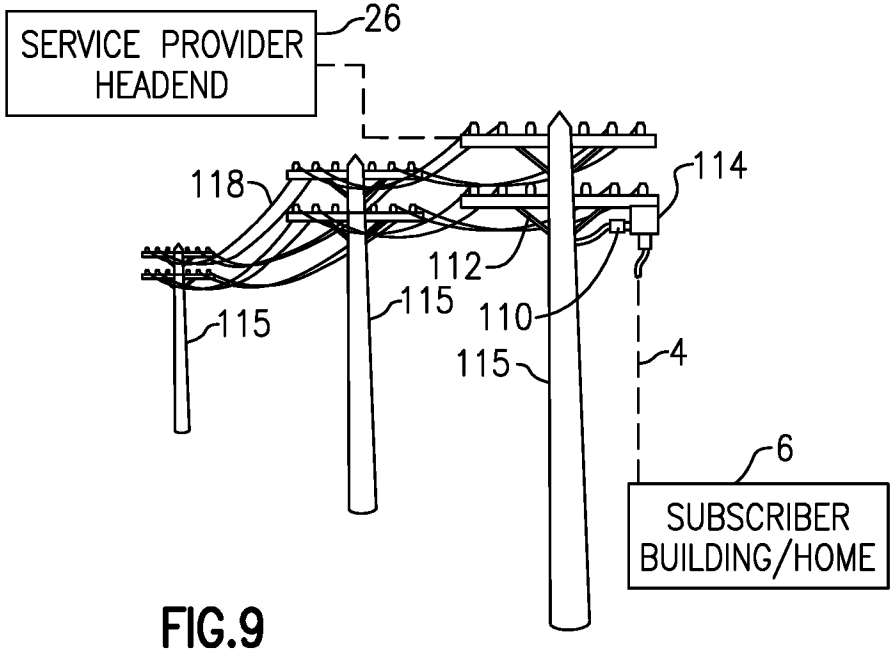
FIG. 9 is a schematic view of a data communication network for exchanging data between a headend facility of a service provider and a data environment of a subscriber wherein the data communication network includes a plurality of coaxial communication cables attached to, and supported by, a plurality of utility poles.

Referring to FIGS. 1 and 9, cable connectors 2 and 110 are attached to cables 4 and 112, respectively, to enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24.

In one embodiment, the set-top unit 22, typically supplied by the data provider (e.g., the cable TV company), includes a TV tuner and a digital adapter for High Definition TV.

In one distribution method, the data service provider operates a headend facility or headend system 26 coupled to a plurality of optical node facilities or node systems, such as node system 28. The data service provider operates the node systems as well as the headend system 26. The headend system 26 multiplexes the TV channels, producing light beam pulses which travel through optical fiber trunklines. The optical fiber trunklines extend to optical node facilities in local communities, such as node system 28. The node system 28 translates the light pulse signals to RF electrical signals.

In one embodiment illustrated in FIG. 9, a drop line coaxial cable 112 is connected to the headend facility 26 of the service provider while the hardline connector 110 couples the drop line coaxial cable 112 to an entry junction device 114. The entry junction device 114 is mounted to, or hung from, a telephone pole 115 or other structure. The cable 112 distributes the service signal from the headend system 26, through connector 110, to the entry junction device 114. In turn, the entry junction device 114 routes the service signal through the hardline connector 2, to the environment 6. The data service provider then uses coaxial cables 4 to distribute the RF signals to the various environments 6. In one embodiment, the entry junction device 114 has a tap or data port 118. In such embodiment, the data port 118 has an internally threaded wall configured to be threadably engaged with the hardline connector 110.

In another distribution method, the data service provider operates a series of satellites. The service provider installs an outdoor antenna or satellite dish at the environment 6. The data service provider connects a coaxial cable to the satellite dish. The coaxial cable distributes the RF signals or channels of data into the environment 6.

In one embodiment, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol (VoIP) phone service, Internet Protocol TV ("IPTV") data streams, multimedia content, audio data, music, radio and other types of data.

In one embodiment, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 a frequencies in the range 1125 MHz to 1675 MHz. MoCA compatible devices can form a private network inside the environment 6.

In one embodiment, the MoCA network includes a plurality of network-connected devices, including, but not limited to: (a) passive devices, such as the PoE filter 8, internal filters, diplexers, traps, line conditioners and signal splitters; and (b) active devices, such as amplifiers. The PoE filter 8 provides security against the unauthorized leakage of a user's signal or network service to an unauthorized party or non-serviced environment. Other devices, such as line conditioners, are operable to adjust the incoming signals for better quality of service. For example, if the signal levels sent to the set-top box 22 do not meet designated flatness requirements, a line conditioner can adjust the signal level to meet such requirement.

In one embodiment, the modem 16 includes a monitoring module. The monitoring module continuously or periodically monitors the signals within the MoCA network. Based on this monitoring, the modem 16 can report data or information back to the headend system 26. Depending upon the embodiment, the reported information can relate to network problems, device problems, service usage or other events.

At different points in the network 5, cables 4 can be located indoors, outdoors, underground, within conduits, above ground mounted to poles, on the sides of buildings and within enclosures of various types and configurations. Cables 4 can also be mounted to, or installed within, mobile environments, such as land, air and sea vehicles.

As described above, the data service provider uses coaxial cable 4 to distribute the data to the environment 6. Therefore, the environment 6 has an array of coaxial cables 4 at different locations. The hardline connectors 2 are attachable to the coaxial cables 4. The cables 4, through use of the hardline connectors 2, are connectable to various communication interfaces within the environment 6, such as interface ports 14 illustrated in FIGS. 1-2. In the examples shown, interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
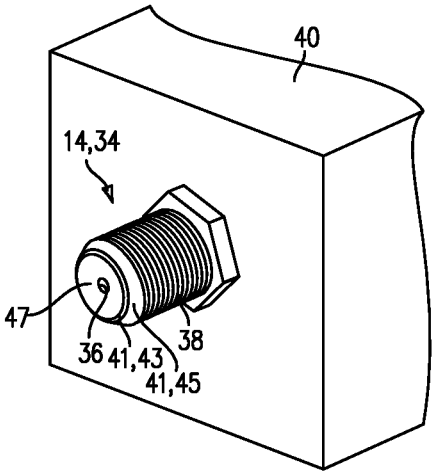
FIG. 2 is an isometric view of one embodiment of an interface port which is configured to be operatively coupled to the multichannel data network.
Figure 4:
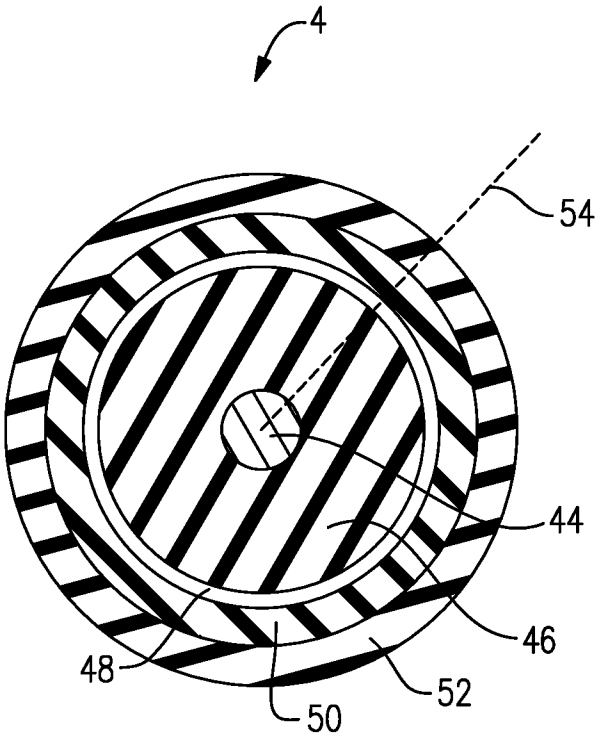
FIG. 4 is a cross-sectional view of the cable of FIG. 3, taken substantially along line 4-4.

In one embodiment, each of the interface ports 14 includes a stud or male jack, such as the stud 34 illustrated in FIG. 2. The stud 34 has an inner, cylindrical wall 36 defining a central hole. Stud 34 has an electrical contact (not shown) positioned within the central hole. In one embodiment, stud 34 is shaped and sized to be compatible with the F-type coaxial connection standard. It should be understood that, depending upon the embodiment, stud 34 could have a threaded outer surface 38 as shown, or stud 34 could have a smooth outer surface. Stud 34 can be operatively coupled to, or incorporated into, a device 40. As described above, device 40 can include, for example, a cable splitter of a distribution box 32, outdoor cable junction box 10 or service panel 12; a set-top unit 22; a TV 24; a wall plate; a modem 16; or a router 18.

During installation, the installer couples a cable 4 to an interface port 14 by screwing or pushing the hardline connector 2 onto the stud 34. Once installed, the hardline connector 2 receives the stud 34. The hardline connector 2 establishes an electrical connection between the cable 4 and the electrical contact of the stud 34.

After installed, the hardline connectors 2 often undergo various forces. For example, there may be tension in the cable 4 as it stretches from one device 40 to another device 40, causing a constant force on a connector 2. A user might occasionally move, pull or push on a cable 4 from time to time, causing forces on a connector 2. A user might frequently swivel or shift the position of a TV 24, causing forces on a connector 2. As described below, the hardline connector 2 is structured to maintain a suitable level of electrical connectivity despite such forces Cable Referring to FIGS. 3-6, the cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in one embodiment, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

Figure 3:
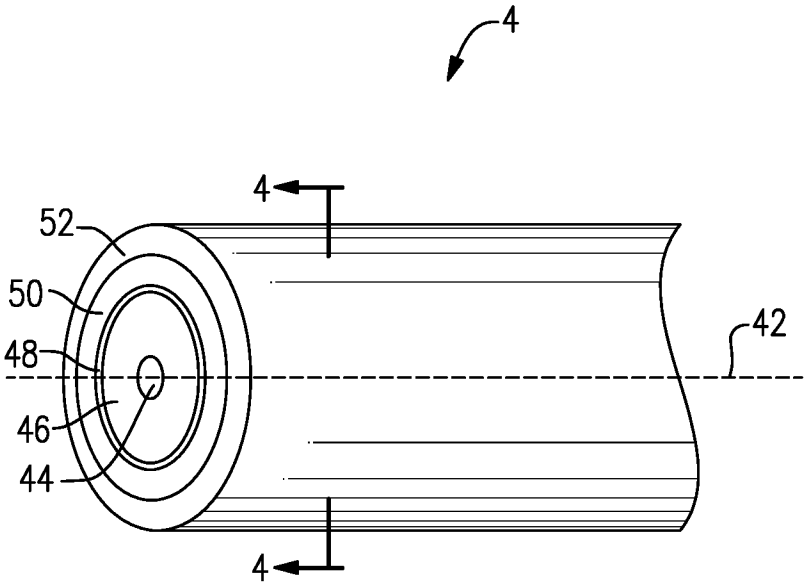
FIG. 3 is an isometric view of one embodiment of a cable which is configured to be operatively coupled to the multichannel data network.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, as described below, the hardline connector 2 electrically grounds the outer conductor 50. When the inner conductor 44 and external electronic devices generate magnetic fields, the grounded outer conductor 50 sends the excess charges to ground. In this way, the outer conductor 50 cancels all, substantially all or a suitable amount of the potentially interfering magnetic fields. Therefore, there is less, or insignificant, disruption of the data signals running through inner conductor 44. Also, there is less, or insignificant, disruption of the operation of external electronic devices near the cable 4.

In such embodiment, the cable 4 has two electrical grounding paths. The first grounding path runs from the inner conductor 44 to ground. The second grounding path runs from the outer conductor 50 to ground.

The conductive foil layer 48, in one embodiment, is an additional, tubular conductor which provides additional shielding of the magnetic fields. In one embodiment, the foil layer 48 includes a flexible foil tape or laminate adhered to the insulator 46, assuming the tubular shape of the insulator 46. The combination of the foil layer 48 and the outer conductor 50 can suitably block undesirable radiation or signal noise from leaving the cable 4. Such combination can also suitably block undesirable radiation or signal noise from entering the cable 4. This can result in an additional decrease in disruption of data communications through the cable 4 as well as an additional decrease in interference with external devices, such as nearby cables and components of other operating electronic devices.

Figure 5:
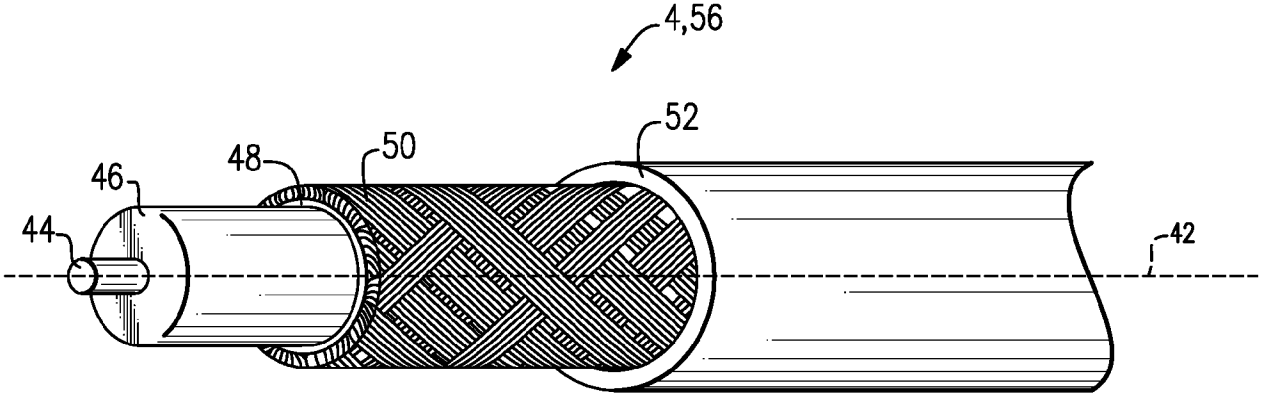
FIG. 5 is an isometric view of one embodiment of a cable which is configured to be operatively coupled to the multichannel data network, illustrating a three step shaped configuration of a prepared end of the cable.
Figure 6:
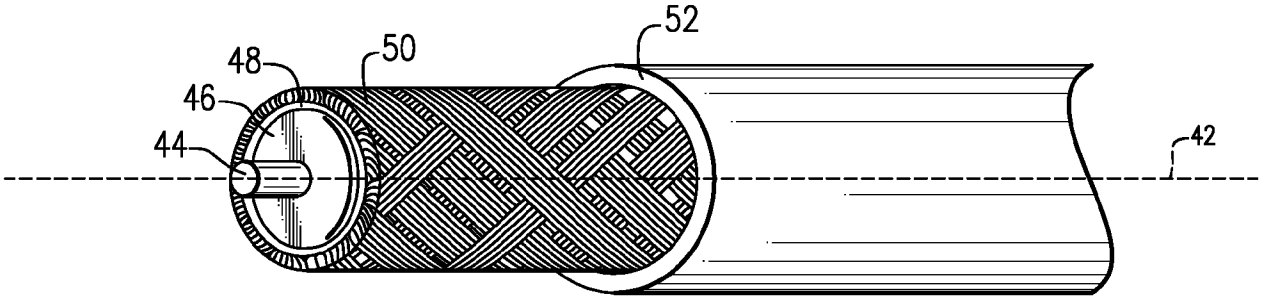
FIG. 6 is an isometric view of one embodiment of a cable which is configured to be operatively coupled to the multichannel data network, illustrating a two step shaped configuration of a prepared end of the cable.

In one embodiment, the jacket 52 has a protective characteristic, guarding the cable's internal components from damage. The jacket 52 also has an electrical insulation characteristic. In one embodiment, the jacket 52 is compressible along the radial line 54 and is flexible along the longitudinal axis 42. The jacket 52 is constructed of a suitable, flexible material such as polyvinyl chloride (PVC) or rubber. In one embodiment, the jacket 52 has a lead-free formulation including black-colored PVC and a sunlight resistant additive or sunlight resistant chemical structure. Referring to FIGS. 5-6, in one embodiment an installer or preparer prepares a terminal end 56 of the cable 4 so that it can be mechanically connected to the hardline connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a three step-shaped configuration. In the example shown in FIG. 6, the prepared end 58 has a two step-shaped configuration. The preparer can use cable preparation pliers or a cable stripping tool to remove such portions of the cable 4. At this point, the cable 4 is ready to be connected to the hardline connector 2.

Figure 7:
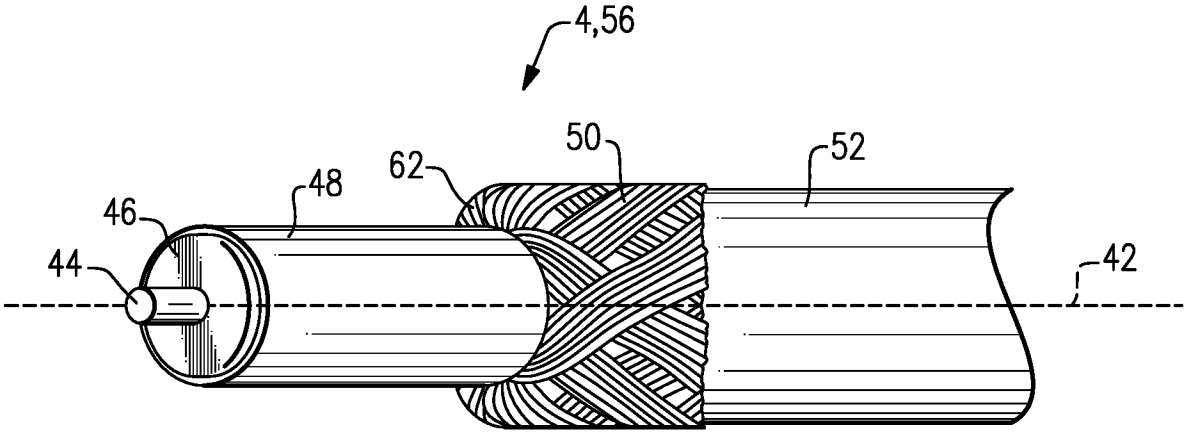
FIG. 7 is an isometric view of one embodiment of a cable which is configured to be operatively coupled to the multichannel data network, illustrating the folded-back, braided outer conductor of a prepared end of the cable.

In one embodiment illustrated in FIG. 7, the installer or preparer performs a folding process to prepare the cable 4 for connection to connector 2. In the example illustrated, the preparer folds the braided outer conductor 50 backward onto the jacket 52. As a result, the folded section 60 is oriented inside out. The bend or fold 62 is adjacent to the foil layer 48 as shown. Certain embodiments of the hardline connector 2 include a tubular post. In such embodiments, this folding process can facilitate the insertion of such post in between the braided outer conductor 50 and the foil layer 48.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 8:
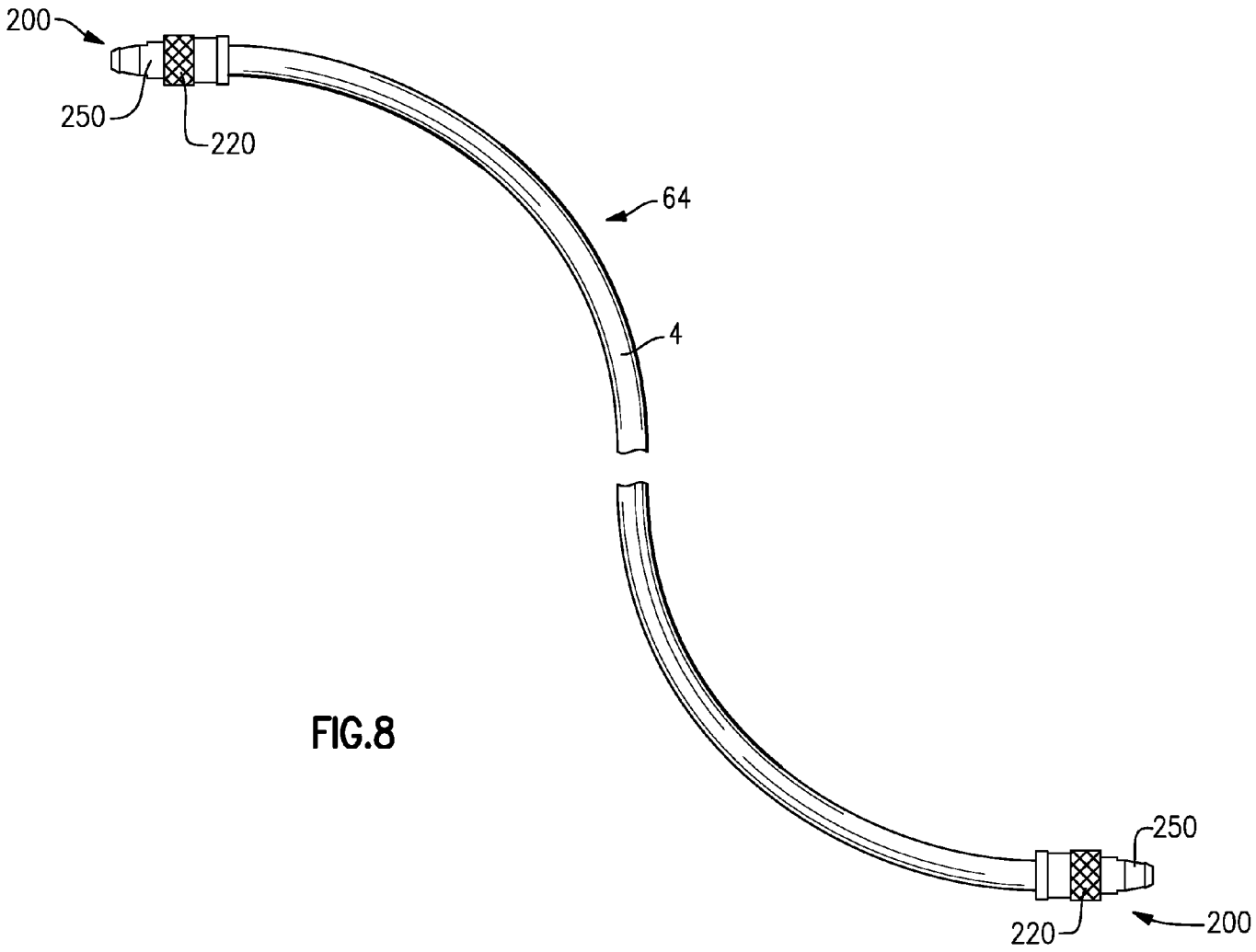
FIG. 8 is a top view of one embodiment of a cable jumper or cable assembly which is configured to be operatively coupled to the multichannel data network.

In one embodiment illustrated in FIG. 8, a cable jumper or cable assembly 64 includes a combination of the hardline connector 2 and the cable 4 attached to the hardline connector 2. In this embodiment, the hardline connector 2 includes: (a) a connector body or connector housing 66; and (b) a fastener or coupler 68, such as a threaded nut, which is rotatably coupled to the hardline connector housing 66.

The cable assembly 64 has, in one embodiment, connectors 2 on both of its ends 70. Preassembled cable jumpers or cable assemblies 64 can facilitate the installation of cables 4 for various purposes.

Connector

Figure 10:
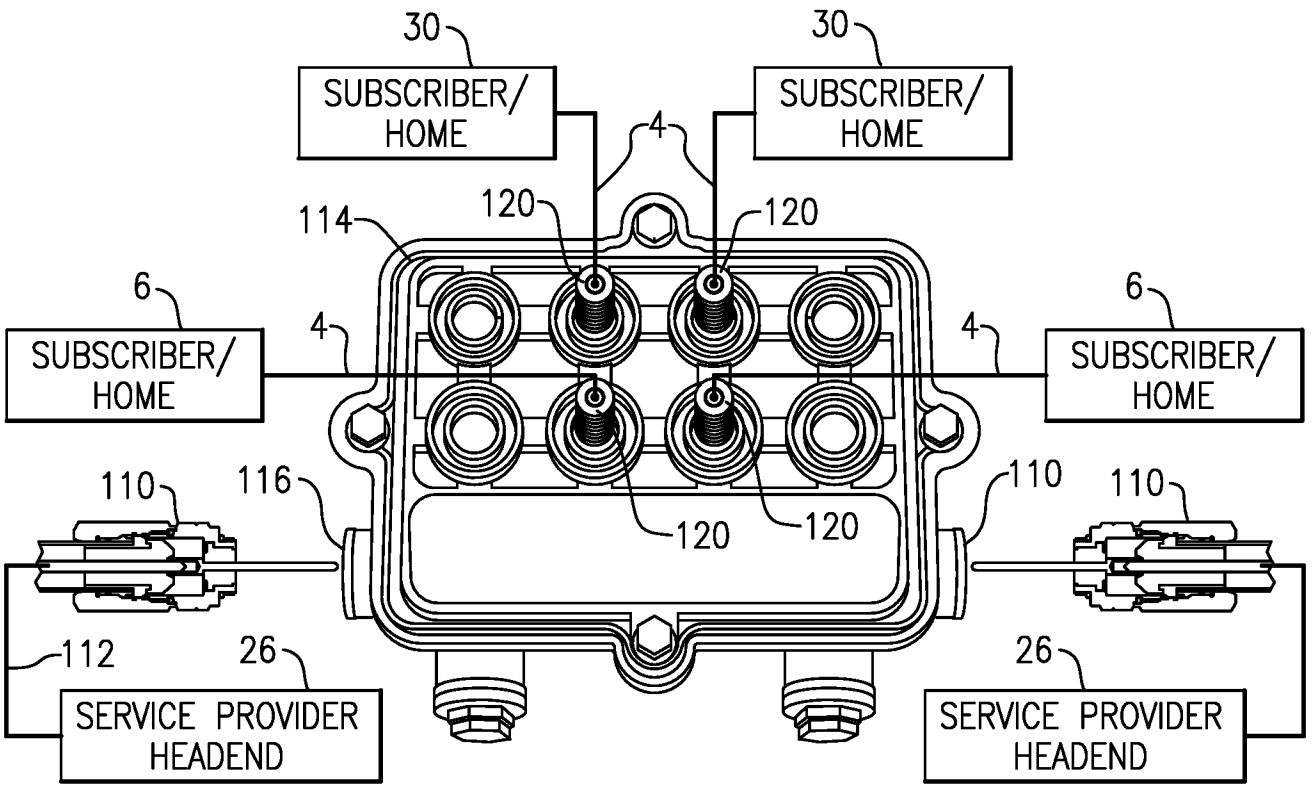
FIG. 10 is a schematic view of an entry junction device, or entry box, having a tap for receiving at least one hardline connector and a plurality of data distribution ports for transmitting RF signals to the data communications environment of a subscriber.

Referring again to FIGS. 9 and 10, a hardened coaxial cable connector or hardline connector 110 is employed in a communication system wherein signal strength and efficacy must remain relatively high to transmit/exchange data communication signals between the headend 26 facility of a service provider and the home environment 6 of a subscriber. The hardline connector 110 couples the drop line cable 112 to an entry junction device 114 (hereinafter "entry box") through the "tap" 116 of the entry box 114. The entry box 114 mounts beneath, and is spatially separated from, the power lines 118 of the utility pole 115 to maintain a safe distance for a cable technician to service the cables/connectors of the cable communication network. Further, the entry box 114 distributes the signal from the drop line cable 112 to a plurality of data ports 120 (FIG. 10). The entry box 114 depicted in FIG. 10 includes four (4) data ports 118, each connecting to a subscriber. A less costly, yet equally reliable, F-type connector 2 may be used to attach a conventional co-axial cable 4 to each of the data ports 118.

From the foregoing discussion it will be appreciated that such connectors 2, 110 may be used in either indoor or outdoor environments. Of course, hardline connectors 110, which are employed at the tap interface 116 of an entry box 114, are exposed to essentially all weather environments, i.e., rain, wind, sunlight (ultraviolet radiation), temperature variations/extremes, anodic/cathodic corrosion, etc. To mitigate the adverse effects of weather on hardline connectors 110, installers can encapsulate the hardline connector 110 in a form-fitting, shrink-wrap blanket (not shown) functioning as a moisture barrier.

Figure 11:
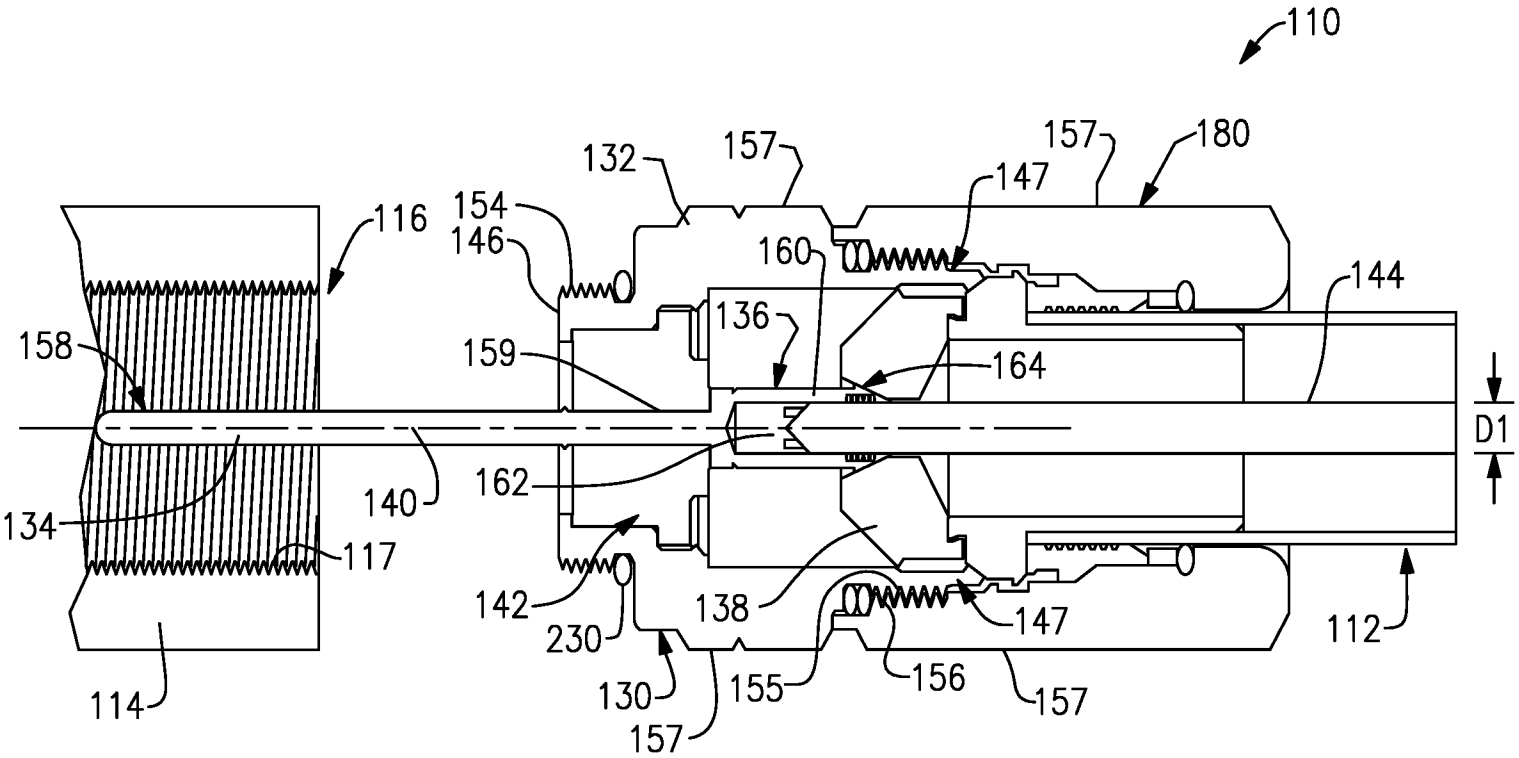
FIG. 11 is a broken away, sectioned side view of a hardline connector including a coupler and body assembly which facilitates assembly/disassembly by a flexible detachable interlock.

In FIG. 11, the hardline connector 110 comprises a coupler assembly 130 and a body assembly 180 which cooperate to lock and unlock along a mating interface. Before discussing the specific structure which enables the locking and unlocking features of the coupler and body assemblies 130, 180, it will be useful to describe the surrounding/interrelated components of the hardline connector 110. More specifically, the coupler assembly 130 comprises: (i) a coupler member 132, (ii) an inner conductor engager 136 received within an aperture 133 of the coupler member 132 and having a contact pin 134 disposed at one end thereof for making electrical contact with an interface port or tap 116 of a junction box 114, and a compressor, driver, or seizure bushing 138 received within the aperture 133 of the coupler member 132.

The coupler member 132 extends along an elongate longitudinal axis 140 and defines an internal coupler space 142. Additionally, the coupler member 132 defines forward and aft portions 146, 147 each defining threaded surfaces. Specifically, the forward coupler portion 146 comprises a forward outer threaded surface 154 which threadably engages the female threads 117 of an interface port of, for example, a tap 116 of the entry box 114. The aft or rearward coupler portion 147 comprises an outer threaded surface 155 which threadably engages female threads 156 the body assembly 180 (discussed in greater detail below in subsequent paragraphs).

The external surface of the coupler and body assemblies 130, 180 may include two or more flat surfaces 157 (best seen in FIG. 13), or, alternatively or additionally define a hexagonal shape, such that a wrench or other torque imparting device may turn or rotate the coupler and body assemblies 130, 180.

The contact pin 134 of the inner conductor engager 136 is at least partially received by the coupler member 132 and also extends along the longitudinal axis 140. The contact pin 134 comprises a forward pin section 158 extendable outside the coupler space 142 and a rearward pin section 159 positionable within the coupler space 142. The forward pin section 158 is configured to be electrically connected to the interface port 116. That is, an aperture (not shown) in the entry box 114 receives the forward pin section 158 and electrically connects thereto for transmitting RF signals to the entry box 114.

The opposite end of the inner conductor engager 136, i.e., opposite the contact pin 134, comprises a plurality of flexible fingers 160 extending along and circumscribing the longitudinal axis 140. The fingers 160 diverge, from the forward end of the inner conductor engager 136 to the tip ends 164 of the fingers 160 and collectively define a surrounding inner conductor engager socket or space 162. The socket 162 is configured to receive the inner conductor 144 of the coaxial cable 112. The dimensions of the space 162 allow for misalignment and thermal expansion of the inner conductor 144. More specifically, the diameter dimension of the space 162 at the rearward end, i.e., the diameter dimension orthogonal to the longitudinal axis 140, is larger than the diameter dimension D1 of the inner conductor 144. As such, the inner conductor 144 is guided into the space 162 even when the inner conductor 140 is misaligned, or is not coincident with, the longitudinal axis 140 of the hardline connector 110. Furthermore, the length of the space 162 allows for expansion and/or contraction of the inner conductor engager 136 due to temperature variations. For example, certain ambient conditions cause the inner conductor 144 to grow by as much as one inch (1"). Accordingly, the inner conductor engager 136 must accommodate axial displacement of the inner conductor 144 within the space 162 to prevent the inner conductor 144 from separating from the inner conductor engager 136 or from buckling, i.e., should the tip end of the conductor 144 contact the closed forward end of the inner conductor engager 136.

Figure 12:
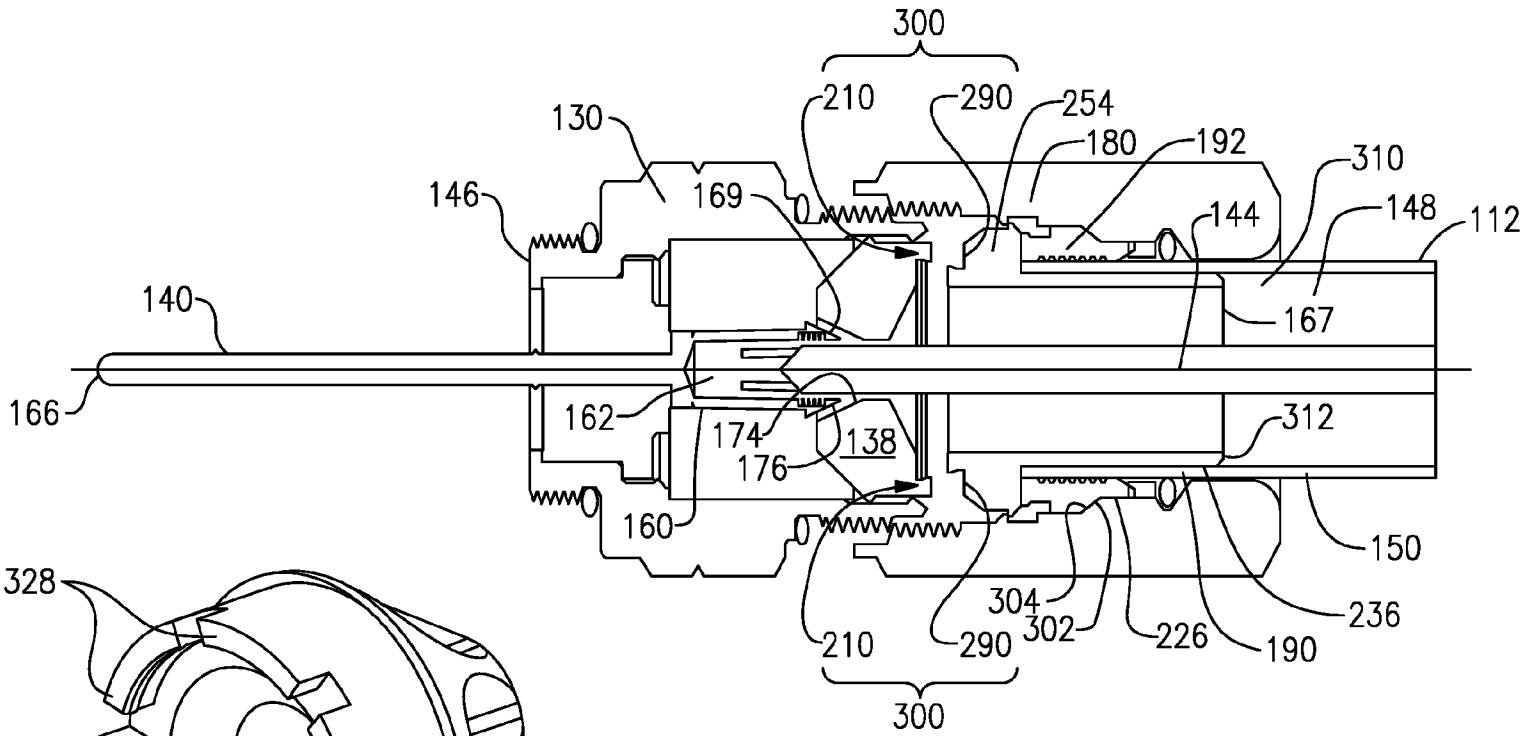
FIG. 12 is an enlarged, sectioned side view of the hardline connector depicting the flexible detachable interlock in greater detail.
Figure 17:
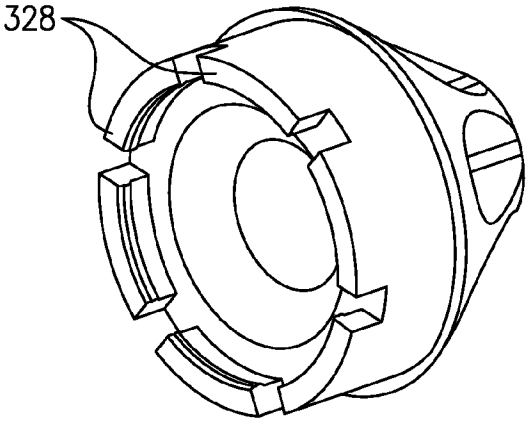
FIG. 17 is an isolated perspective view of a seizure bushing having a plurality of axial slots formed in an annular wall of an interlock portion to facilitate radial deflection and flexibility of the interlock portion.
Figure 13:
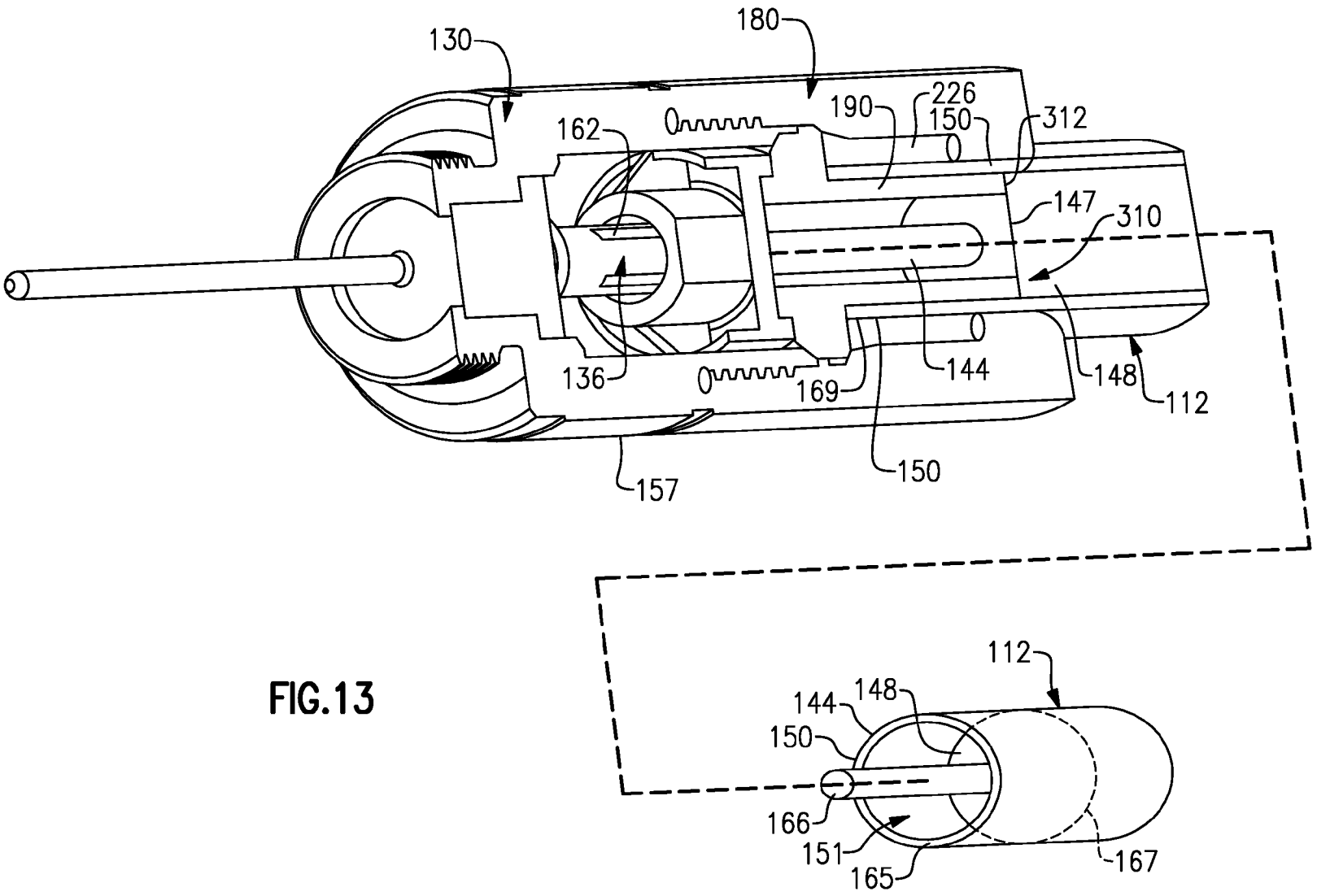
FIG. 13 is an broken-away, sectioned perspective view of the hardline connector including an end view of a coaxial cable being prepared for attachment to the hardline connector.
Figure 14:
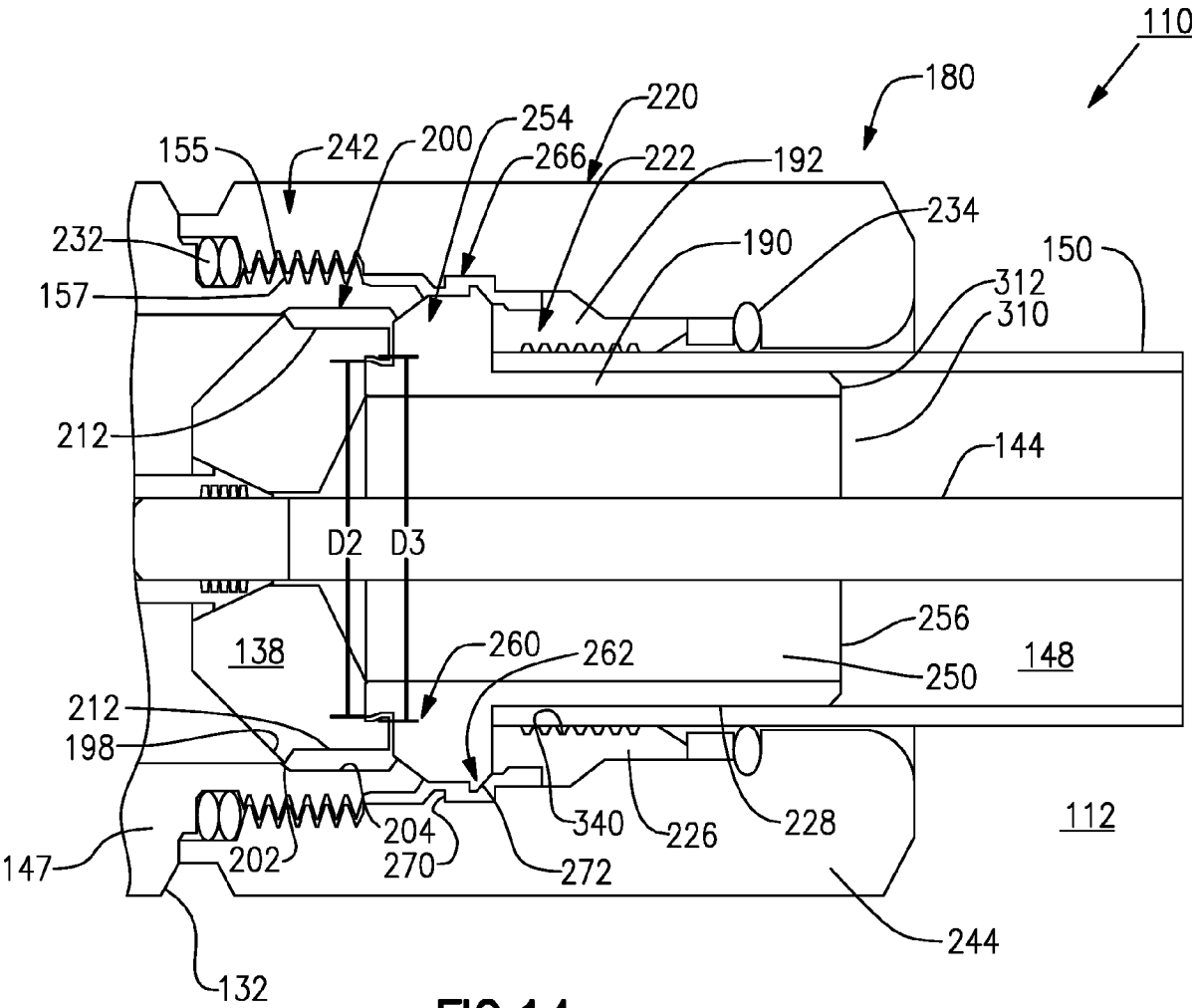
FIG. 14 is a enlarged, broken-away, sectioned side view of an aft portion of the hardline connector, i.e., the body assembly, depicting the method for attaching the hardline connector in greater detail.

In FIGS. 12-14, the inner conductor 144 axially extends into the inner conductor engager 136 leaving sufficient axial space therein to accommodate thermal expansion/contraction. In a first step, the installer cuts the cable 112 so as to expose a length of the inner conductor 144. This dimension (best seen in FIG. 13) measures from the edge 165 of the cut outer sheath 150 of the coaxial cable to the end 166 of the inner conductor 144. Next, the installer cores the dielectric material 148 such that the sheath or sleeve 150 of the cable 112 extends beyond the end 167 of the dielectric material 148. This dimension measures from the end 167 of the dielectric material 148 to the edge 165 of the sheath sleeve 150.

As will be discussed in greater detail below when describing the operation and assembly of the hardline connector 110, the cored dielectric material 148 abuts an internal mandrel support 190 (see FIG. 14) of the body assembly 180 to compress the fingers 160 into engagement with the inner conductor 144. Sufficient axial space remains within the inner conductor engager 136 to accommodate thermal expansion/contraction of the inner conductor 144. Furthermore, the cored cable 112 leaves an annular space or cavity 151 between the inner conductor 144 and the outer sheath sleeve 150. Accordingly, when the inner conductor 144 extends into the inner conductor engager 136, the outer sheath sleeve 150 follows the inner conductor 144 axially an annular space 169 between mandrel support 190 and a split-ring structure 192. When the coupler and body assemblies 130, 180 join, the spit-ring structure 192 compresses, and axially retains, the sleeve 150 against the mandrel support 190.

The compressor, driver or seizure bushing 138 is received by, and moves relative to, the coupler member 132. Furthermore, the seizure bushing 138 defines an opening 174, substantially coaxial with the opening 133 of the coupler member 132, to receive the inner conductor 144 of the coaxial cable 4. Additionally, the seizure bushing 138 engages at least a portion of the flexible fingers 160, i.e., the tip end portions 164 thereof, to drive the fingers 160 radially inward toward the longitudinal axis 140. More specifically, the seizure bushing 138 defines a frustoconical surface 176 for engaging complementary surfaces 178 of the tip end 164 of each finger 160. As the inner conductor 144 is inserted into the aft end of the body assembly 180, the sheath 150 of the coaxial cable 112 abuts the mandrel support 190 which urges the seizure bushing 138 forwardly toward the fingers 160 of the inner conductor engager 136. As mentioned in the preceding paragraph, the axial displacement of the seizure bushing 138 effects radially inward displacement of the fingers 160 and electrical contact with the inner conductor 144.

Figure 15:
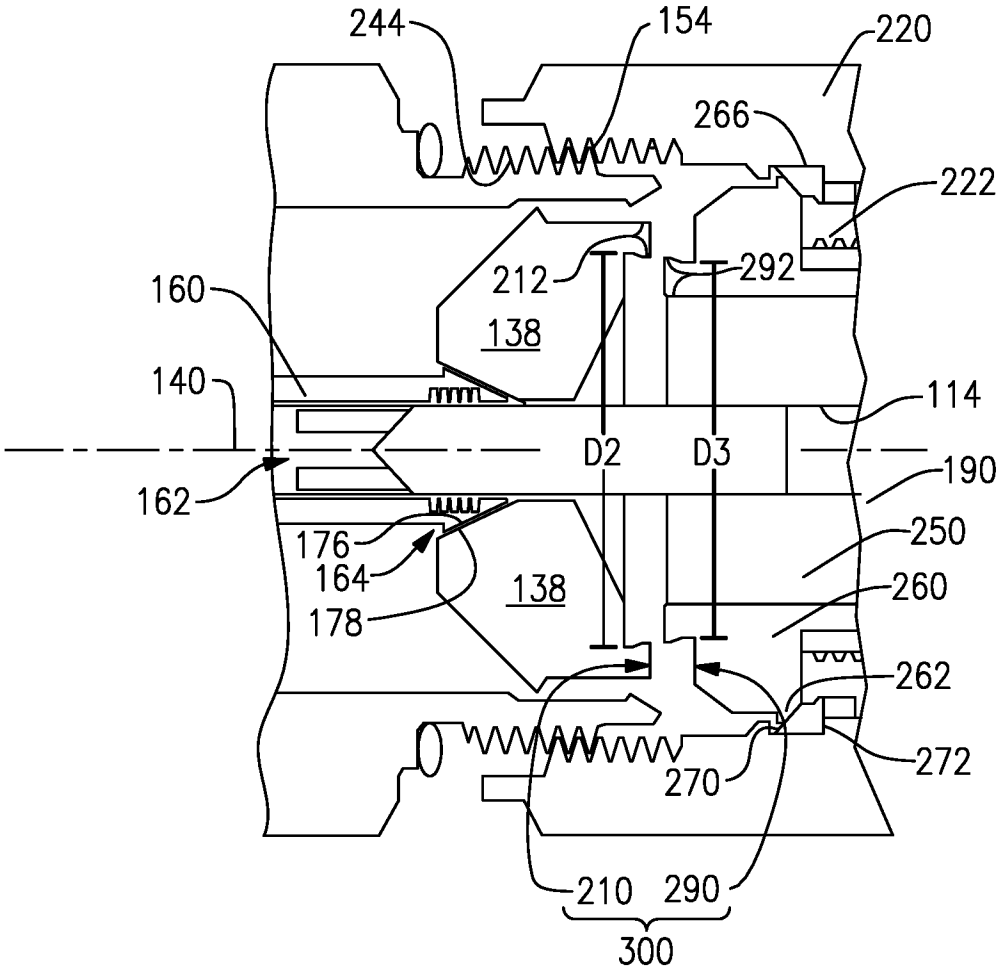
FIG. 15 is an enlarged, broken-away, sectioned side view of the threaded interface between the coupler and body assembly depicting a first and second interlock, respectively, of the detachable interlock.

In FIGS. 13-15, the seizure bushing 138 includes at least one radial projection 198 operative to be snap-fit into an annular groove 200 formed in the coupler member 132. The annular groove 200 is defined by forward and aft shoulders 202, 204 operative to axially retain the seizure bushing 138 within a narrow band of axial displacement. Finally, the seizure bushing 138 includes a first interlock portion 210 defining a compliant annular interlock wall 212. The annular interlock wall 212 projects axially along the longitudinal axis 140 and defines an inner diameter D2. Furthermore, at least part of the annular interlock wall 212 is flexible such that a portion of the wall 212 may flex outwardly to increase the inner diameter D2.

The body assembly 180 comprises: (i) a body 220 defining a body space 222, (ii) the mandrel support 190 moveably received within the body space 222, (iii) a clamp 226 operative to engage/capture the sleeve 150 of the coaxial cable 114 against an outer cylindrical surface 228 of the mandrel support 190, and (iv) a plurality of seals 230, 232, 234 operative to seal the coupler and body assemblies 130, 180 to each other, the entry box 114, and the coaxial cable 112. More specifically, the body 220 is extendable along the longitudinal axis 140 and is configured to receive the inner conductor 144. Furthermore, the body 220 comprises forward and rearward body portions 242, 244 wherein the forward body portion 242 is configured to, at least partially, receive the rearward portion 147 of the coupler member 132. In the described embodiment, the forward body portion 242 includes the forward inner threaded surface 155 configured to threadably engage the rearward outer threaded surface 157 of the coupler member 132.

In FIGS. 14 and 15, the mandrel support 190 extends along the longitudinal axis 140 and is received within the body space 222 of the body 220. Further, the mandrel support 190 defines a support space 250 configured to receive the inner conductor 114 and defines forward and reward portions 254, 256 (FIG. 14). The forward support 254 (best seen in FIG. 15) comprises a collar 260 having at least one radial projection 262 operative to be snap-fit into an annular groove 266 formed in the body member 220. The annular groove 266 is defined by forward and aft shoulders 270, 272 operative to axially retain the collar 260, and consequently the mandrel support 190, within a narrow band of axial displacement.

The collar 260 includes a second interlock portion 290 defining a annular interlock wall 292. The annular interlock wall 292 projects axially along the longitudinal axis 140 and defines an outer diameter D3. In the described embodiment at least a portion of the annular interlock wall 292 is flexible such that a portion of the wall 292 may flex inwardly to decrease the outer diameter D3. The first and second annular walls 212, 292 of the seizure bushing 138 and mandrel support 190, i.e., the walls 212, 292 forming the first and second interlocks 210, 290, may include a plurality of axial slots (not shown) about the periphery or circumference thereof to vary the flexibility of one or both of the interlocks 210, 290.

The rearward support portion 256 of the mandrel support 190 is integral with, and aft of, the collar 260. Furthermore, the rearward portion 256 is cylindrically shaped and supports the sleeve 150 of the coaxial cable 112. Moreover, the rearward support portion 256 functions to extend the mandrel support 190 rearwardly toward the coaxial cable 112 such that the dielectric insulator 148 thereof engages the rearward support portion 256. These structural features will become clear in subsequent paragraphs when describing the connection between the coaxial cable 112 and the body assembly 180.

The coupler and body assemblies 130, 180 define a detachable interlock 300 at the first and second interlock portions 210, 290 of the seizure bushing 138 and mandrel support 190, respectively. In the described embodiment, the first interlock portion 210 is a snap fit groove projecting aft of the seizure bushing 138. The second interlock portion 290 is a snap fit ring projecting forwardly of the mandrel support 190. More specifically, at least one of the first and second interlock portions 210, 290 are configured to move or flex between a locked position and an unlocked position. In the locked position, the first and second interlock portions 210, 290 are locked together, or attached, in a snap-fit arrangement. The first and second interlock portions 210, 290 remain engaged through the application of a first threshold force sufficient to decouple the seizure bushing 138 from the inner conductor engager 136. It will be recalled that the elements of the connector 110 may become fused over time due to the harsh operating environment of the connector 110.

In the described embodiment, the first threshold force may be applied over a short stroke, or increment of axial displacement, between the coupler and body assemblies 130, 180. The axial displacement is provided by the annular groove 200 in the internal surface of the coupler assembly 136. That is, the annular groove 200 facilitates axial displacement of the seizure bushing 138 as the radial projection 198 moves between the first and second shoulders 202, 204 of the groove 200. A second threshold force, larger than the first, applied to the body assembly 180 effects a second displacement to disassemble the body and coupler assemblies 180,130. During the movement, i.e., the second displacement, the second threshold force temporarily increases/decreases the diameters D2, D3 allowing the annular ring of the mandrel support 190 to move out of, or passed, the annular groove of the seizure bushing 138.

Figure 16:
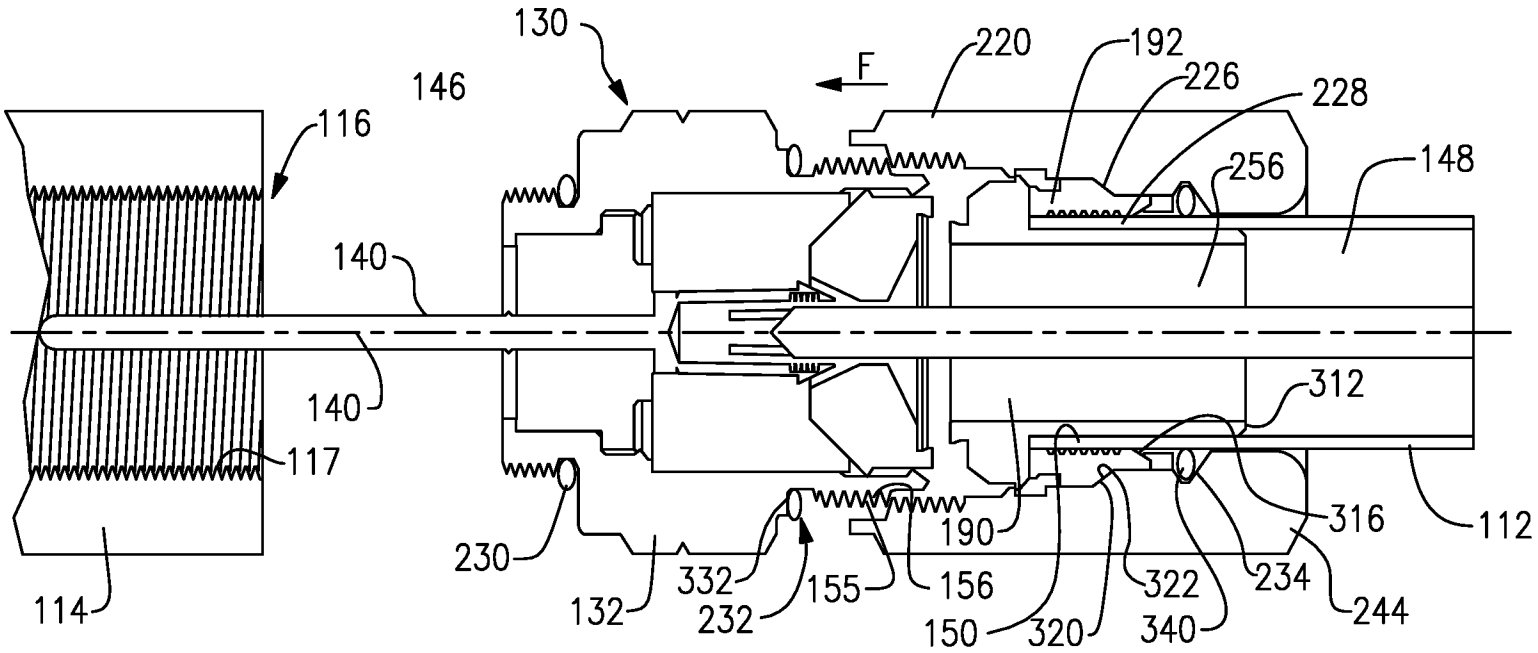
FIG. 16 is a broken away, sectioned side view of the hardline connector for depicting an interface, intermediary and cable sealing assembly.

In FIGS. 14 and 16, the clamp 226 defines a clamp opening 316 configured to at least partially receive the sleeve 150. Furthermore, it should be appreciated that the sleeve 150 at least partially surrounds the insulator or dielectric material 148 of the coaxial cable 112 while in the body assembly 180. The clamp 226 is also configured to at least partially receive the rearward support portion 256 of the mandrel support 190.

More specifically, the clamp 226 comprises a split-ring structure 192 and an outer clamp surface 318. The outer clamp surface 318 comprises a first ramp, or tapered surface, 320 operative to engage a second ramp, or tapered surface, 322 formed in combination with the inner surface 324 of the forward body portion 242. As the body 220 moves forward in the direction of arrow F, the first and second ramp surfaces 320, 322 cooperate to cause the clamp 190 to compress the sleeve 150 radially toward the cylindrical outer surface 228 of the rearward support portion 256 of the mandrel support 190. As a consequence the sleeve 150 is captured or sandwiched between the clamp 192 and the mandrel support 190. In the described embodiment, the clamp 190 includes a plurality of engaging teeth, or a knurled irregular surface 340 to develop a mechanical interlock between the clamp 190 and the sleeve 150.

During assembly, the coupler assembly 130 threadably engages a threaded interface port, e.g., the tap 116 of the entry box 114. The threaded attachment causes the interface port 116 to engage the forward interface seal 230 which is retained within a ring-shaped groove 330 of the forward coupler portion 146 of the coupler member 132. Next, the female threads 155 of the forward body portion 242 threadably engage the male threads 156 of the rearward portion of the coupler member 132. At this juncture in the assembly, the seizure bushing 138 and mandrel supports 180 are loosely held in place by engagement of the radial projections 204, 262 with the respective annular grooves 200, 272 disposed in each of the coupler and body assemblies 130, 180. In a next step, the coaxial cable 112 inserts into the aft end 310 (FIG. 12) of the body assembly 180. When inserted, the inner conductor 144 enters the inner conductor engager space 162 while the seizure bushing 138 moves axially to radially compress the fingers 160 of the inner conductor 136 into contact with the inner conductor 144.

The seizure bushing 138 is moved by the axial displacement of the mandrel support 190 which, in turn, is urged forward against the seizure bushing 138 by the inner dielectric material 148. That is, the mandrel support 190 is driven forward when the inner dielectric material 148 abuts the aft end 312 of the rearward support 256. When the seizure bushing 138 can no longer move forward against the reactive force of the inner conductor engager 136, i.e., when the fingers 160 can be compressed radially no further, the interlock 300 is prepositioned to lock into position. More specifically, the locked position may be effected by forcibly urging the cable 112, i.e., the dielectric 148 against the aft end 312 of the mandrel support 190. Further, the female threads 156 of the body assembly 180 engage the male threads 155 of the coupler member to bring the interlocks 210, 290 together into locking engagement. At the same time, the second or intermediary seal 232 is produced. The intermediary seal 232 is retained within a ring-shaped groove 332 (FIG. 16) located forwardly of the coupler member threads 155. The intermediary seal 232 forms against the forward body portion 242 of the body assembly 180 and the rearward coupler portion 147 of the coupler assembly 130.

Finally, i.e., as the threaded interface 155, 156 is established, the body assembly 180 engages the split-ring clamp 192 to compress and engage the sleeve 150 of the coaxial cable 112. More specifically, ramped or tapered surface 320, disposed on the inner cylindrical surface of the body 180 engages the tapered or ramped surface 322 of the split-ring clamp 192. As this final assembly step is performed, a cable seal 234 is formed between the coaxial cable 112 and the rearward body portion 244 of the body assembly 180. The cable seal 234 seats within a ring-shaped groove 340 of the rearward body portion 244.

The detachable interlock 300 facilitates assembly and disassembly of the cable connector 110 without damage to the internal components thereof. The detachable interlock allows a small degree of axial displacement before the interlock 300 becomes functional by either engaging or disengaging the coupler 130 from the body 180, or the seizure bushing 138 from the mandrel support 190. More specifically, during disassembly, the interlock 300 remains engaged through an axial displacement which effects the separation of the seizure bushing 138 from the inner conductor engager 136. That is, the connector 110 is configured to provide sufficient axial retention of the seizure bushing 138, i.e., by the axial displacement provided between the annular projection 198 and the annular groove 200, while the interlock 300 provides sufficient axial retention to separate the frustoconical surface 176 of the seizure bushing 138 from the tapered ends 164 of each finger 160 of the inner conductor engager 136. It will be recalled that these elements may become environmentally fused during the service life of the connector 110.

Inasmuch as the intermediate threaded connection between the coupling and body assemblies 130, 180 controls the axial displacement therebetween, it is this connection which determines when the interlock 300 becomes functional. Once the seizure bushing 138 releases the inner conductor engager 136, a technical can apply additional axial force, by turning the threads or pulling the cable and body assemblies 112, 180, to unlock the interlock 330, i.e., to move the first and second interlock portions from a locked to an unlocked position. By separating the movement and releasing one portion of the coupling connection, i.e., the threaded connection, from another portion, i.e., an internal connection between the mandrel support 190 and the seizure bushing 138, the connector 110 may disassembled and reassembled numerous times without damage to the internal components making the necessary structural and electrical connections. In this way, the connector 110 is configured to be repeatedly reused in circumstances where, over time, there is a need to periodically disconnect a cable and then reconnect the cable.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A coaxial cable connector comprising:

a coupler assembly comprising:

a coupler member extendable along an axis, the coupler member defining a coupler space, and including:

(i) a forward coupler portion having a forward outer threaded surface that is configured to threadably engage a threaded interface port; and (ii) a rearward coupler portion having a rearward outer threaded surface;

a contact pin configured to be at least partially received by the coupler member, the contact pin configured to extend along the axis, the contact pin comprising:

(i) a forward pin section configured to extend outside of the coupler space, the forward pin section configured to be electrically connected to the interface port; and (ii) a rearward pin section configured to be positioned within the coupler space;

an inner conductor engager configured to be connected to the rearward pin section, and defining an inner conductor engager space, the inner conductor engager comprising a plurality of flexible fingers configured to surround the inner conductor engager space, the inner conductor engager space configured to receive an inner conductor of a coaxial cable;

a compressor configured to be received by the coupler body, and defining a compressor opening arranged to receive the inner conductor, the compressor opening further configured to:

move relative to the coupler member until at least a portion of the flexible fingers receive the inner conductor, and compress the flexible fingers in a radially inward direction so as to engage the inner conductor when the inner conductor is inserted into the inner conductor engager space; and wherein the compressor further comprises a compressor interlock, the compressor interlock comprising a compressor interlock wall extending along the axis, the compressor interlock wall being predisposed to define an inner diameter, at least part of the compressor interlock wall being flexible so as to increase the inner diameter;

a body assembly comprising:

a body configured to extend along the axis, the body defining a body space configured to receive the inner conductor, the body comprising:

(i) a forward body portion configured to at least partially receive the rearward coupler member portion, the forward body portion comprising a forward inner threaded surface configured to be threadably engaged with the rearward outer threaded surface; and (ii) a rearward body portion;

a support moveably received within the body space, the support extending along the axis and defining a support space configured to receive the outer conductor, the support comprising:

(i) a forward support portion comprising a collar and a support interlock, the support interlock configured to be moved between: a locked position in which the compressor interlock and the support interlock are locked together through a snap-fit arrangement; and an unlocked position in which the compressor interlock and the support interlock are unlocked from each other, the inner diameter varying during the movement; and (ii) a rearward support portion comprising a sleeve extending rearwardly from the collar, the sleeve configured to engage an insulator of the coaxial cable, the insulator at least partially surrounding the inner conductor;

a clamp defining a clamp opening configured to at least partially receive an outer conductor portion of the coaxial cable, the outer conductor portion at least partially surrounding the insulator, the clamp also configured to at least partially receive the rearward support portion, the clamp comprising a split-ring structure having an outer clamp surface, the outer clamp surface comprising a ramp, the forward body portion configured to cooperate with the ramp to cause the clamp to compress the sleeve radially toward the extension so that the outer conductor portion is sandwiched between the clamp and the support; and a plurality of seals including:

(i) an interface seal configured to engage the interface port;

(ii) an intermediary seal configured to seal the coupler member and the body; and (iii) a cable seal configured to seal the body assembly to an outer jacket of the coaxial cable.

2. A hardline connector comprising:

a coupler assembly comprising:

a coupler member extendable along an axis;

a contact pin at least partially received by the coupler member, the contact pin configured to be electrically connected to an interface port;

an inner conductor engager connected to the contact pin, the inner conductor engager comprising a plurality of fingers that are arranged to surround a space shaped to receive an inner conductor of a coaxial cable;

a seizure bushing configured to be received by the coupler body, and having a first interlock portion configured to:

(i) move relative to the coupler member; and (ii) compress the fingers in a radially inward direction;

a body assembly including a body extendable along the axis, and a support moveably received within the body and configured to receive the outer conductor, the support having a second interlock portion configured to be moved between a locked position, where the first and second interlock portions are locked together, and an unlocked position, where the first interlock portion and the second interlock portion are unlocked from each other, and wherein at least one of the first and second interlock portions is configured to flex when the second interlock portion of the support of the body assembly moves between the locked position and the unlocked position.

3. The hardline connector of claim 2, wherein the first and second interlock portions define a flexible interlock disposed between the body assembly and the coupler assemblies, the flexible interlock configured to apply a first threshold force to separate the coupler and body assemblies by an axial displacement, and configured to apply a second threshold force, larger than the first threshold force, to disassemble the hardline connector.

4. The hardline connector of claim 3, wherein the axial displacement separates the seizure bushing from the inner conductor engager.

5. The hardline connector of claim 3, wherein the seizure bushing is operative to drive the inner conductor engager into electrical contact with the inner conductor of the coaxial cable and includes a radial projection for engaging an annular groove along an internal surface of the coupler assembly, the annular groove including a pair of shoulders defining the length of the axial displacement.

6. The hardline connector of claim 3, wherein the flexible interlock includes a first interlock defining a snap-fit groove and a second interlock defining a snap fit ring.

7. The hardline connector of claim 6, wherein the seizure bushing includes a first annular interlock wall projecting rearwardly from the aft end of the seizure bushing and wherein the mandrel support includes a second annular wall projecting forwardly from the mandrel support, the first and second annular walls being compliant to enable snap-fit engagement of the interlock portions.

8. The hardline connector of claim 7, wherein one of the first and second annular interlock walls include a plurality of axial slots about the periphery to vary the flexibility of one of the interlocks.

9. The hardline connector of claim 3, wherein the flexible interlock defines a first snap-fit connection between the seizure bushing and the mandrel support.

10. The hardline connector of claim 9, further comprising a second snap fit connection between the seizure bushing and an annular groove formed within an internal surface of the coupler assembly and a third snap-fit connection between the mandrel support and an annular groove formed within an internal surface of the body assembly.

11. A coaxial cable connector comprising:

a body configured to be secured to a prepared end of a coaxial cable;

a coupler interposing the body and an interface port, and detachably connected to each, the coupler supporting an inner conductor engager having a pin socket at one end thereof;

an interlock disposed within a cavity defined by the body and coupler assemblies, the interlock including a seizure bushing and a support mandrel, the interlock including a snap-fit connection between the seizure bushing and a support mandrel;

wherein the seizure bushing is configured to separate from the inner conductor engager in response to a first axial displacement of the interlock; and wherein the body is configured to separate from the coupler in response to a second axial displacement relative to the first axial displacement.

12. The connector of claim 11 wherein a first threshold force is applied between the body and coupler assemblies to separate the seizure bushing from the inner conductor engager, wherein a second threshold force is applied between the seizure bushing and the mandrel support.

13. The connector of claim 12 wherein the second threshold force is greater than the first threshold force.

14. The connector of claim 13, wherein one of the snap-fit grooves and snap-fit ring includes a plurality of axial slots disposed about a peripheral portion to vary the flexibility of one of the interlock.

15. The connector of claim 11, wherein the seizure bushing is configured to drive the inner conductor engager into electrical contact with an inner conductor of the coaxial cable.

16. The connector of claim 11, wherein the seizure bushing is mounted between a first pair of shoulders formed by an annular groove formed within a wall of the coupler assembly.

17. The connector of claim 11, wherein the snap-fit connection includes a snap-fit groove formed on one of the seizure bushing and the mandrel support, and a snap fit ring formed on the other of the seizure bushing and the mandrel support.

18. A coaxial cable connector comprising:

a body configured to engage a coaxial cable;

a coupler configured to be coupled to the body and an interface port and move between a locked position relative to the body, where the coupler is electrically coupled to an inner conductor of the coaxial cable and snap-fit engaged with the body so as to prevent the body from being disassembled from the coupler, and an unlocked position relative to the body, where the coupler is not electrically coupled to the inner conductor of the coaxial cable and is not snap-fit engaged with the body so as to allow the body to be disassembled from the coupler, and wherein the coupler includes a bushing that is configured to form a mechanical connection with the inner conductor of the coaxial cable when the coupler is in the locked position relative to body; and wherein the bushing of the coupler is configured to release the mechanical connection with the inner conductor of the coaxial cable before the coupler moves to the unlocked position so as to allow the body to be disassembled from the coupler after the mechanical connection with the inner conductor of the coaxial cable has been released and avoid damaging internal components of the connector.

19. The connector of claim 18, wherein the bushing is mounted between a first pair of shoulders formed by an annular groove formed within a wall of the coupler.

20. The connector of claim 18 wherein the body and coupler are snap-fit engaged by an interlock disposed between the bushing and a mandrel disposed in combination with the body.

21. The connector of claim 20, wherein the interlock comprises a first interlock portion formed in combination with one of the bushing and the mandrel, and a second interlock portion formed in combination with the other one of the bushing and the mandrel, and wherein at least one of the first and second interlock portions is configured to flex and release to enable the interlock portions to move between the locked and the unlocked positions.

22. The connector of claim 20, wherein the interlock comprises first and second interlock portions disposed between the body and the coupler, the interlock portions configured to apply a first threshold force to separate the coupler and body by an axial displacement, and configured to apply a second threshold force, larger than the first threshold force, when the interlock portions move between the locked and unlocked positions.

23. The connector of claim 22, wherein the first threshold force displaces the body from the coupler to separate the bushing from the inner conductor.

24. The connector of claim 23, wherein the second threshold force disassembles the body from the coupler.

25. The connector of claim 24, wherein the bushing includes a radial projection for engaging the annular groove disposed along an internal surface of the coupler, the shoulders of the annular groove defining the length of axial displacement.

26. The connector of claim 24, wherein the interlock includes a first interlock defining a snap-fit groove and a second interlock defining a snap fit ring.

27. The connector of claim 24, wherein the bushing includes a first interlock wall projecting rearwardly from the aft end of the bushing and wherein the mandrel includes a second interlock wall projecting forwardly from the mandrel, the first and second interlock walls being compliant to enable snap-fit engagement of the interlock portions.

28. The connector of claim 24, wherein one of the first and second interlock wall portions includes a plurality of axial slots about the periphery to vary the flexibility of one of the interlocks.

29. A coaxial cable connector comprising:

a body configured to engage a coaxial cable a coupler configured to be coupled to the body and an interface port;

wherein the coupler is configured to move to a locked position, where the coupler forms a first connection with an inner conductor of the coaxial cable and forms a second connection with the body so as to prevent the body from being disassembled from the coupler when the coupler is in the locked position, in response to a first displacement force;

wherein the coupler is configured to move to an unlocked position, where the coupler has released the first connection with the inner conductor of the coaxial cable and has released the second connection with the body so as to allow the body to be disassembled from the coupler, in response to a second displacement force greater than the first displacement force; and wherein the coupler is configured to release the first connection with the inner conductor of the coaxial cable before releasing the second connection with the body so as to allow the body and coupler to be disassembled from one another without damaging internal components of the connector;

wherein the body includes an internal mandrel, wherein the coupler includes a bushing, and wherein the bushing and mandrel are configured to form the second connection between the body and the coupler and wherein the second connection includes a snap-fit interlock between the bushing and the mandrel.

30. The connector of claim 29 wherein the coupler includes a bushing that is configured to form the first connection with the inner conductor of the coaxial cable.

31. The connector of claim 29, wherein the bushing is mounted between a first pair of shoulders formed by an annular groove formed within a wall of the coupler.

32. The connector of claim 29, wherein the snap-fit interlock comprises a first interlock portion formed in combination with one of the bushing and the mandrel, and a second interlock portion formed in combination with the other one of the bushing and the mandrel, and wherein at least one of the first and second interlock portions is configured to flex and release to enable the interlock portions to move between the locked and the unlocked positions.

33. The connector of claim 29, wherein the snap-fit interlock comprises first and second interlock portions are disposed between the body and the coupler, the interlock portions configured to apply a first threshold force to separate the coupler and body by an axial displacement, and configured to apply a second threshold force, larger than the first threshold force, when the interlock portions move between the locked and unlocked positions.

34. The connector of claim 33, wherein the first threshold force displaces the body from the coupler to separate the bushing from the inner conductor.

35. The connector of claim 34, wherein the second threshold force disassembles the body from the coupler.

36. The connector of claim 34, wherein the bushing includes a first interlock wall projecting rearwardly from the aft end of the bushing and wherein the mandrel includes a second interlock wall projecting forwardly from the mandrel, the first and second interlock walls being compliant to enable snap-fit engagement of the interlock portions.

37. A coaxial cable connector comprising:

a body configured to engage a coaxial cable;

a coupler configured to engage an interface port and the body, and move between a locked position, where the coupler forms a first connection with an inner conductor of the coaxial cable and forms a second connection with the body so as to prevent the body from being disassembled from the coupler when the coupler is in the locked position, and an unlocked position, where the coupler has released the first connection with the inner conductor of the coaxial cable and has released the second connection with the body so as to allow the body to be disassembled from the coupler;

wherein the coupler is configured to release the first connection before releasing the second connection so as to prevent the first connection from damaging the inner conductor of the coaxial cable when the body and coupler are disassembled from one another, wherein the body includes an internal mandrel, wherein the coupler includes a bushing, and wherein the bushing and mandrel are configured to form the second connection between the body and the coupler, and wherein the second connection includes a snap-fit interlock between the bushing and the mandrel.

38. The connector of claim 37, wherein the coupler is configured to move to the locked position when a first displacement force is applied to the coupler.

39. The connector of claim 38, wherein the coupler is configured to move to the unlocked position when a second displacement force is applied to the coupler.

40. The connector of claim 39 wherein the snap-fit interlock comprises a first interlock portion formed in combination with one of the bushing and the mandrel, and a second interlock portion formed in combination with the other one of the bushing and the mandrel, and wherein at least one of the first and second interlock portions is configured to flex and release to enable the interlock portions to move between the locked and the unlocked positions.

41. The cable connector of claim 39, wherein the snap-fit interlock comprises first and second interlock portions are disposed between the body and the coupler, the interlock portions configured to apply a first threshold force to separate the coupler and body by an axial displacement, and configured to apply a second threshold force, larger than the first threshold force, when the interlock portions move between the locked and unlocked positions.

42. The connector of claim 39, wherein the second displacement force is greater than the first displacement force.

43. The connector of claim 37 wherein the coupler includes a bushing that is configured to form the first connection with the inner conductor of the coaxial cable.

44. The connector of claim 37, wherein the bushing is mounted between a first pair of shoulders formed by an annular groove formed within a wall of the coupler.

* * * * *